US005292135A

United States Patent [19]

Menke

[11] Patent Number: 5,292,135

[45] Date of Patent: Mar. 8, 1994

[54] DART GAME

[75] Inventor: Wilhelm Menke, Ingelheim, Fed. Rep. of Germany

[73] Assignee: NSM Aktiengesellschaft, Bingen

[21] Appl. No.: 934,614

[22] PCT Filed: Mar. 2, 1991

[86] PCT No.: PCT/DE91/00190

§ 371 Date: Sep. 8, 1992

§ 102(e) Date: Sep. 8, 1992

[87] PCT Pub. No.: WO91/14147

PCT Pub. Date: Sep. 19, 1991

[30] Foreign Application Priority Data

Mar. 5, 1990 [DE] Fed. Rep. of Germany ..... 4006850

[51] Int. Cl.[5] ..... F41J 5/04

[52] U.S. Cl. ..... 273/376

[58] Field of Search ..... 273/376, 374, 373, 371; 312/321.5, 324, 326

[56] References Cited

U.S. PATENT DOCUMENTS

| | | | |
|---|---|---|---|
| 3,454,276 | 7/1969 | Brenkert et al. | 273/376 |
| 4,976,441 | 12/1990 | Kim | 273/376 |
| 5,004,247 | 4/1991 | Menke | 273/376 |

FOREIGN PATENT DOCUMENTS

| | | | |
|---|---|---|---|
| 0332003 | 9/1989 | European Pat. Off. | 273/376 |
| 8805521 | 7/1988 | PCT Int'l Appl. | 273/376 |

*Primary Examiner*—Benjamin H. Layno

*Attorney, Agent, or Firm*—Spencer Frank & Schneider

[57] ABSTRACT

A darts target for a game of darts has mobile segments marked with different scores and provided with holes for receiving the darts and is articulated inside a front door of a housing. When a dart strikes the segments, which are prevented from moving forward by retaining devices, the segments actuate a switch matrix which is arranged on a supporting disk and which automatically registers, totals and displays the scores by means of a switching system. The front door is articulated to the housing on one of its vertical longitudinal sides by a hinge. The supporting disk with the switch matrix is fastened to the rear face of the front door so that it can be folded back.

5 Claims, 3 Drawing Sheets

DART GAME

The invention relates to a dart game including a dart board that is inserted in a front door articulated to a housing and whose movable segments that are covered with different point values are provided with holes to accommodate the thrown darts. When a dart hits one of the segments which are prevented from moving forward by retaining devices, the segment actuates a switch matrix disposed on a carrier plate which by way of a switching device automatically records, counts and displays the scored points.

Such dart games are known in the most varied embodiments. For example, DE 3,723,298.A1 discloses a dart game that includes a dart board attached in an opening in the front wall of a housing, with its movable segments that are occupied by different point values being provided with holes to accommodate the thrown darts. When a dart hits them, the segments actuate, by way of an elastic support, a group of switches disposed between the support and a carrier plate so as to permit by way of electrical and/or electronic components automatic recording, counting and display of the scored points. The elastic support, the group of switches and the carrier plate as a unit can here be folded away with the dart board from the front wall and then from the dart board. The dart board is held at the front wall of the housing by way of a joint and a locking device that is disposed opposite the joint. The carrier plate is connected with the dart board by way of a joint and, when folded in, lies in the front wall against a corresponding stop on the housing side of the front wall. Although it is possible in this dart game to obtain free access to the rear of the dart board segments by merely two folding processes so as to remove broken arrowheads or possibly exchange defective segments, the dart board inserted in the front wall has a certain degree of instability since, in its operating position, the dart board is held only by the joint and the locking device with the result that it is possible to grip behind the dart board from the side by means of a tool to perform unauthorized manipulations at the dart game body.

In addition, EP 0,332,003.A1 discloses a dart game equipped with an electronic hit display which is provided with a service door formed by at least part of the housing front for access to the interior of the device from the front of the housing. The service door which supports the dart board is connected with the housing by way of a hinge attached to its lower end. Because of this hinge, the service door can be pivoted between a generally vertical operating position and a service position in which the service door extends outwardly from the front of the housing by a predetermined angle of less than 180°. In order to prevent the service door from pivoting into a position which exceeds the predetermined angle, at least one flexible member of appropriate length is provided between the service door and the housing. In the service position of the service door, retaining devices prevent the segments from falling out of the radial and concentric ribs of the dart board. In this position, it is possible to remove a supporting plate for a switch matrix that is associated with the dart board segments and is fastened to the rear face of the service door by means of screws after loosening these screws in order to remove broken arrowheads from the dart board or to replace damaged segments. After the removal of the broken arrowheads from the dart board and after the replacement of damaged segments, the supporting plate and the switch matrix must again be placed onto the retaining screws and must be fixed in its position by means of nuts that are screwed onto the retaining screws. Such a manner of proceeding for the removal of broken arrowheads is thus inevitably extremely complicated and time consuming which consequently leads to unduly long interruptions of play. In addition, at least one flexible member in the form of a chain is required in this dart game in addition to the hinge between the service door and the housing.

It is the object of the invention to provide a dart game of the above-mentioned type in which the removal of broken arrowheads that are stuck in the dart board and the exchange of damaged dart board segments is ensured in a simple and quick way with the dart board remaining fixed.

This is accomplished according to the invention in that the front door is articulated to the housing by way of a hinge at one of its vertical long sides and the carrier plate together with the switch matrix are fastened to the rear face of the front door in such a manner that they can be folded away.

The solution according to the invention makes it possible to obtain free access to the rear of the dart board segments from the front door by simply opening the front door and then folding away the carrier plate accommodating the switch matrix in order to remove broken arrowheads or to exchange possibly defective segments. Afterwards, it again requires only two folding processes, of course in the reverse sequence, to make the dart game ready for play. Such a manipulation in which the dart board always remains in its fixed, inserted position in the front door, can be performed very quickly and thus requires only a short interruption of play. Moreover, no special component is required to hold the opened front door in its position.

In an advantageous embodiment of the invention, the carrier plate accommodating the switch matrix is held at the rear face of the front door by means of a joint and a locking device that is disposed opposite the joint. In this case, the joint is preferably arranged between the carrier plate and the front door adjacent to the hinge connecting the front door with the housing. In this way, an overdue stress on the hinge is avoided when the front door is opened and the carrier plate is folded away.

In order to keep the movable dart board segments in their positions even if the carrier plate is folded away, an advantageous feature of the invention provides that the segments which lie between radial and concentric ribs on the dart board, when the carrier plate is folded away, are secured against dropping out of the dart board by means of guide devices. Advisably, each segment is provided with two associated guide devices at a defined distance from one another at its radial longitudinal sides.

In order to realize a guide device that is easy to manufacture, a further advantageous feature of the invention provides that each guide device is provided with a projection that projects in the direction of the facing radial rib from the end of a tongue that is connected with the respective longitudinal side of the segment. This projection is clipped with the appropriate play into the rib in an undercut cutout in the rib. To facilitate the attachment of the projection to the flap of the segment in the associated cutout in the corresponding radial rib, the undercut cutout in the radial rib of each guide device is preferably provided with oppositely disposed chamfers at its inlet. Advisably, the guide devices of adjacent segments are arranged with a mutual offset. This results in a space saving arrangement of the guide devices.

For an alternative use of the dart game as a stand-alone or wall-mounted device, the housing accommodating all operating components is preferably configured to have a base to make it into a stand-alone housing or, without a base, as a wall-mounted housing.

The concept on which the invention is based will now be described in greater detail with reference to an embodiment thereof that is illustrated in the drawing figures, in which.

Figure 1:
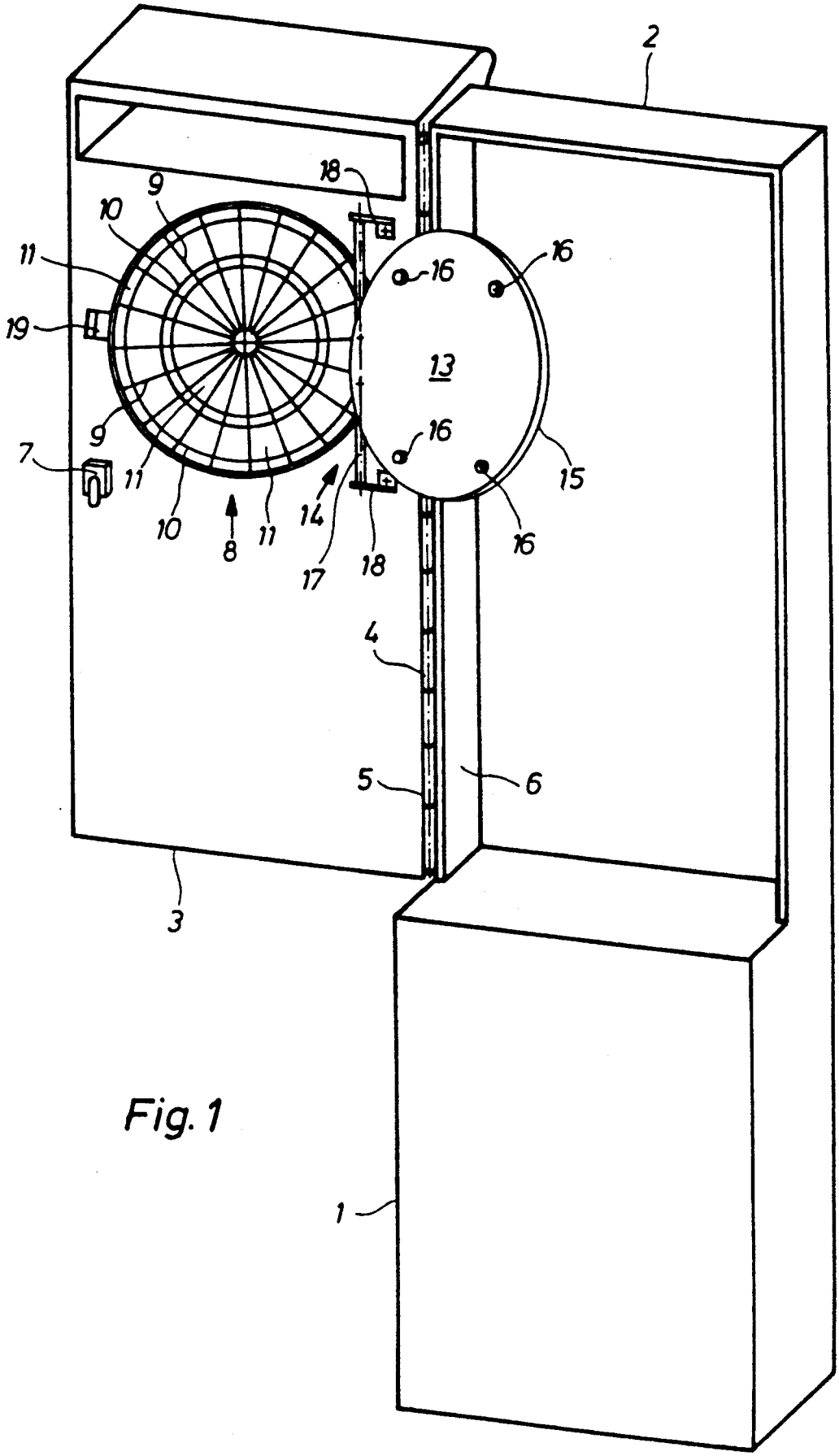
FIG. 1 is a perspective view of the dart game according to the invention with the front door opened toward the side and with the carrier plate accommodating the switching matrix being folded away from the rear face of the front door, while the further components required to operate the dart game are omitted for better clarity.
Figure 2:
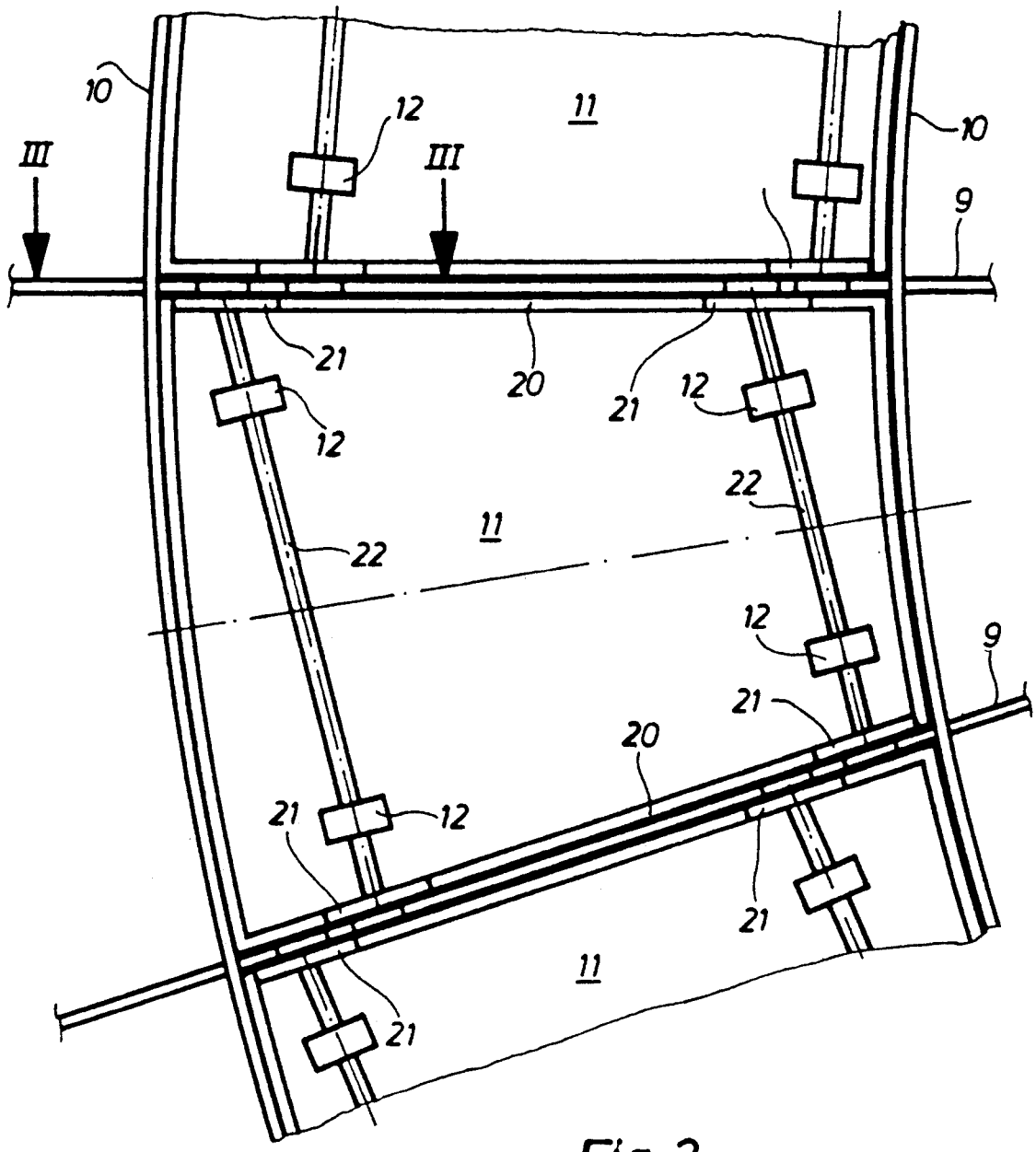
FIG. 2 is an enlarged sectional rear view of the dart board of the dart game of FIG. 1.
Figure 3:
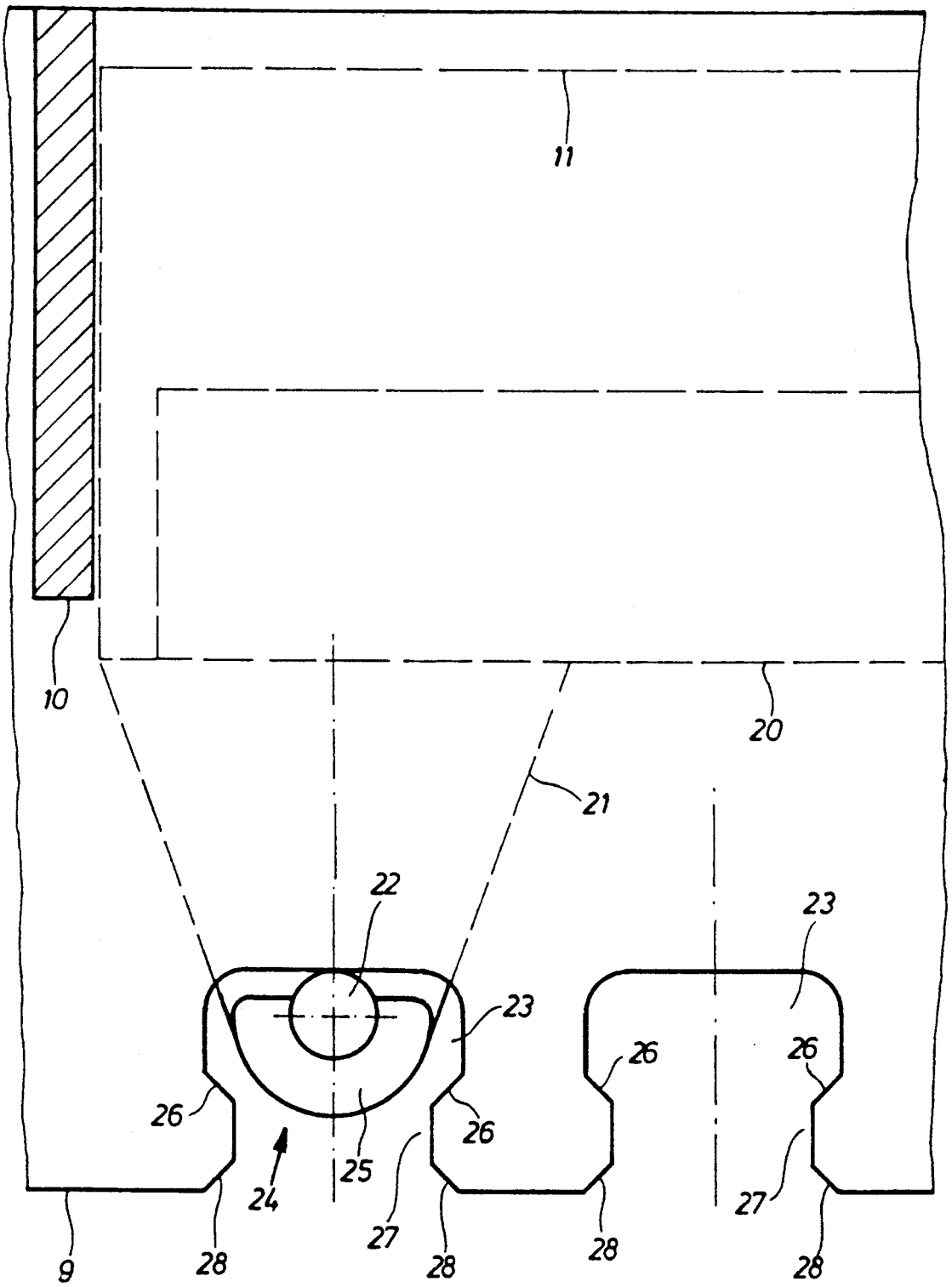
FIG. 3 is a sectional view to an enlarged scale of the illustration of FIG. 2 seen along line III—III.

The housing 2 which includes a base 1 and accommodates all operating components of the dart game has a rectangular front door 3 which is articulated to the housing 2 by means of a hinge 4 in the form of a piano hinge. Hinge 4 is attached, on the one hand, to the vertical longitudinal side 5 of front door 3 and, on the other hand, to the corresponding side wall 6 of the housing, with the front door 3 opening either to the right or left out of the housing 2. Opposite hinge 4, there is a key lock 7 in front door 3 in order to enable the front door 3, when in the closed position, to be locked to housing 2. The housing 2, which may be combined with base 1 and configured as a stand-alone housing may of course also be built without a base and used as a wall-mounted housing.

A dart board 8 is fixedly inserted into front door 3 and is provided with a plurality of radial ribs 9 which are arranged at equal angular distances from one another. Radial ribs 9 are connected with a plurality of concentric ribs 10 that are arranged at different spacings from one another. In the spaces between ribs 9 and 10, slidable segments 11 are provided with a plurality of non-illustrated openings into which the tip of an arrow is able to enter. Each segment 11 is provided with contact members 12 that cooperate with associated push-down switches of a switch matrix 13 that is embedded in a foil. By way of pins 16 that project in the direction of segments 11, a carrier plate 15 foldably fastened to the rear face of front door 3 by way of a hinge 14 accommodates the switch matrix 13. The joint 14 on carrier plate 15 includes a pivot axis 17 that extends parallel and adjacent to hinge 4 and is mounted at its ends in holders 18 that are provided at the rear wall of front door 3. Opposite pivot axis 17, which is fixed to carrier plate 15, a locking device 19 is provided on the rear wall of front door 3 next to dart board 8 so as to hold the carrier plate 15 accommodating the switch matrix 13 in its operating position. If thus, with front door 3 and carrier plate 15 closed, a segment 11 is hit by an arrow, this segment moves in the direction toward carrier plate 15 so that at least one contact member 12 of segment 11 closes an associated pushdown switch of switch matrix 13. The thus generated hit pulse is conducted to a central microprocessor which controls all game functions including recording, counting and displaying the points scored on the basis of the different point values associated to the segments.

Each segment 11 is provided with two flaps 21 that are shaped at a defined distance from one another to its rear face at its radial long sides 20. The respectively oppositely disposed flaps 21 on the long sides 20 of segment 11 carry a shaft 22 on which two contact members 12 in the form of contact rollers are mounted. The free ends of each shaft 22 project beyond the flaps 21 of segment 11 and engage in a cutout 23 of the respectively facing radial rib 9 of dart board 8 in such a manner that segment 11 is unable to slide out of the dart board 8 toward the front. To prevent the segments 11 from sliding out of dart board 8 toward the rear when carrier plate 15 has been folded away, each segment 11 is limited in its free rearward movement by way of guide devices 24. Each guide device 24 includes a projection 25 that projects laterally outwardly at flap 21 and is clipped with appropriate play into the cutout 23 in the facing radial rib 9 which is provided with oppositely disposed undercuts 26. The width of projection 25 is here slightly larger than the width of the entrance 27 of cutout 23. To facilitate the clipping process, oppositely disposed chamfers 28 are provided on the entrance 27 of cutout 23. Guide devices 24 and thus of course also the flaps 21 bearing shafts 22 of adjacent segments 11 are arranged in a laterally offset manner so as to provide for a compact configuration.

If now a broken arrowhead must be removed from a segment 11 of dart board 8, with the dart game in the operating position, the front door 3 can be pivoted, after the key lock 7 has been opened, into the open position shown in FIG. 1. Then locking device 19 at the rear wall of front door 1 must be released and then the carrier plate 15 accommodating switch matrix 13 must be brought into the folded away position shown in FIG. 1. Thus the segment 11 of dart board 8 including the broken arrowhead is freely accessible from the rear so that the broken arrowhead can easily be pushed out of the segment, with segment 11 being unable to drop out of dart board 8 either toward the front due to the interaction of shafts 22 with the cutouts 23 in the radial ribs 9 or toward the rear because of the guide devices 24. At the same time, any possibly damaged segments and/or switch matrix 13 can be quickly exchanged. At the end of the above work it is merely necessary to fold the carrier plate 15 and its switch matrix 13 back into its starting position, to fix it in its position by means of closing device 19 and to lock front door 3 to housing 2 by means of key lock 7, whereupon the dart game is ready for play again.

The features of the invention disclosed in the above specification, in the drawings and in the claims may be significant, individually as well as in any desired combination, for a realization of the invention in various embodiments.

I claim:

1. An electronic dart game apparatus comprising a housing having a front door hinged to a vertical longitudinal side of said housing and a dart board inserted into a recess of said front door, said dart board being formed of a plurality of radially extending ribs and a plurality of concentric circular ribs dividing said dart board into a plurality of scoring areas, a plurality of movable segments, each scoring area having a respective movable segment therein, each movable segment being adapted to be hit by the tip of a thrown dart, said movable segments each having a limited forward and back movement within their respective scoring areas, said movable segments being arranged so that when any of said movable elements is hit by a thrown dart, the hit movable segment moves backwards and actuates a switch matrix disposed on a carrier plate located behind said dart board to permit, by way of a switching device, automatic recording, counting and display of the points scored, said carrier plate, together with said switch matrix being hingedly fastened to the rear face of the front door behind said dart board sot hat said carrier plate is foldable away from said dart board and said front door for servicing, said dart board further comprising a plurality of guide devices connected to each of said movable segments and connected to said dart board ribs securely retaining each of said movable segments in its respective scoring area and preventing said movable segments from falling out of the front and rear of the dart board when said front door and said carrier plate are folded away for servicing.

2. A dart game according to claim 1, wherein each segment has radial longitudinal sides and two associated guide devices that are disposed at a defined distance from one another at each of said radial longitudinal sides.

3. A dart game according to claim 1, wherein each guide device includes a projection that is shaped to the end of a flap connected with the respective longitudinal side of the segment and projects in the direction of the facing radial rib while being clipped with appropriate play into an undercut cutout in the respective rib.

4. A dart game according to claim 1, wherein said undercut cutout in the radial rib of each guide device is provided with oppositely disposed chambers at an inlet of each respective guide device.

5. A dart game according to claim 1, wherein the guide devices of adjacent segments are offset relative to one another.

* * * * *